US006986354B1

(12) United States Patent
Burns

(10) Patent No.: US 6,986,354 B1
(45) Date of Patent: Jan. 17, 2006

(54) MOUTHGUARD

(75) Inventor: Peter Burns, Artarmon (AU)

(73) Assignee: Signature Mouthguards Pty. Limited, Artarmon (AU)

( * ) Notice: Subject to any disclaimer, the term of this patent is extended or adjusted under 35 U.S.C. 154(b) by 0 days.

(21) Appl. No.: 09/719,058

(22) PCT Filed: Jun. 11, 1999

(86) PCT No.: PCT/AU99/00458

§ 371 (c)(1),
(2), (4) Date: Feb. 7, 2001

(87) PCT Pub. No.: WO99/64121

PCT Pub. Date: Dec. 16, 1999

(30) Foreign Application Priority Data

Jun. 11, 1998 (AU) ..... PP4098

(51) Int. Cl.
*A61C 5/14* (2006.01)

(52) U.S. Cl. ..... 128/859; 128/861

(58) Field of Classification Search ..... 128/846, 128/848, 859–862; 602/902
See application file for complete search history.

(56) References Cited

U.S. PATENT DOCUMENTS

| | | | | |
|---|---|---|---|---|
| 2,192,558 A | | 3/1940 | Poindexter | |
| 2,827,899 A | | 3/1958 | Altieri | |
| 2,966,908 A | * | 1/1961 | Cathcart et al. | 128/861 |
| 3,073,300 A | | 1/1963 | Berghash | |
| 3,411,501 A | | 11/1968 | Greenberg | |
| 3,457,916 A | | 7/1969 | Wolicki | |
| 5,031,638 A | | 7/1991 | Castaldi | |
| 5,082,007 A | | 1/1992 | Adell | |
| 5,152,301 A | * | 10/1992 | Kittelsen | 128/861 |
| 5,339,832 A | * | 8/1994 | Kittelsen | 128/859 |
| 5,406,963 A | * | 4/1995 | Adell | 128/862 |
| 6,082,363 A | * | 7/2000 | Washburn | 128/859 |

* cited by examiner

*Primary Examiner*—Michael Anthony Brown
(74) *Attorney, Agent, or Firm*—Ladas & Parry

(57) ABSTRACT

A mouthguard (10) of "C" shaped configuration having a forward portion (11) from which there rearwardly diverges a pair of arms (12). The mouthguard (10) in transverse cross section is of a "U" shaped configuration. In one embodiment each arm (12) is provided with a ridge (22) which acts as a shield, while the forward portion (11) is thickened so as to provide a labial shield (23).

27 Claims, 17 Drawing Sheets

MOUTHGUARD

TECHNICAL FIELD

The present invention relates to mouthguards and more particularly, but exclusively, to mouthguards used by sports participants.

BACKGROUND OF THE INVENTION

Mouthguards have consisted of a number of types, including those constructed of thermoplastics material, which are heated (typically in hot water) and then applied to the user's mouth so that the mouthguard is moulded to fit the user's teeth and jaw. A more expensive type of mouthguard is that provided generally by dentists. The "custom fitted" dentist provided mouthguards are manufactured from an impression taken of the user's teeth and jaw. Plastics material is then formed in a mould generated from the impression. More recently, laminated pressure mouthguards have been made available.

The above discussed types of mouthguards fall short of providing the desired level of protection for the user.

OBJECT OF THE INVENTION

It is the object of the present invention to overcome or substantially ameliorate the above disadvantage.

SUMMARY OF THE INVENTION

There is disclosed herein a mouthguard of generally "C-shaped" configuration so as to provide a front portion and two arms diverting rearwardly from the front portion, the mouthguard being of a "U-shaped" transverse cross-section so as to provide an inner and an outer flange joined by a base.

The mouthguard described herein has a first inventive feature which includes the base having a lower surface providing a lower occlusal table which is generally perpendicular to the inner flange.

A second inventive feature described herein includes the base having an upper occusual table which is inclined to the inner flange by an angle between 100 and 120 degrees.

A third inventive feature described herein includes a thickened portion of said outer flange being provided at said front part.

A fourth inventive feature described herein includes the base having a lower surface provided with a shield adjacent the outer flange extending substantially along each arm.

A fifth inventive feature described herein includes said base having an upper surface, with the forward portion thereof being raised relative to arm portions thereof.

A sixth inventive feature described herein includes the mouthguard being formed of a body having said "C-shaped" configuration, with said two arms having end extremities, said mouthguard further including a labial shield embedded in said front portion and extending therefrom through the two arms to adjacent the extremities thereof, said body and shield being formed of plastics material, with said shield being more rigid than said body.

Preferably the above mentioned shield is a single piece.

In a further preferred form said above mentioned shield includes a front part embedded in said front portion, and two rear parts separate to the front part, each rear part being located in a respective one of the arms.

A seventh inventive feature described herein includes said base being formed with deformable projections, which are plastically deformed to conform to the configuration of a user's teeth.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

Figure 1:
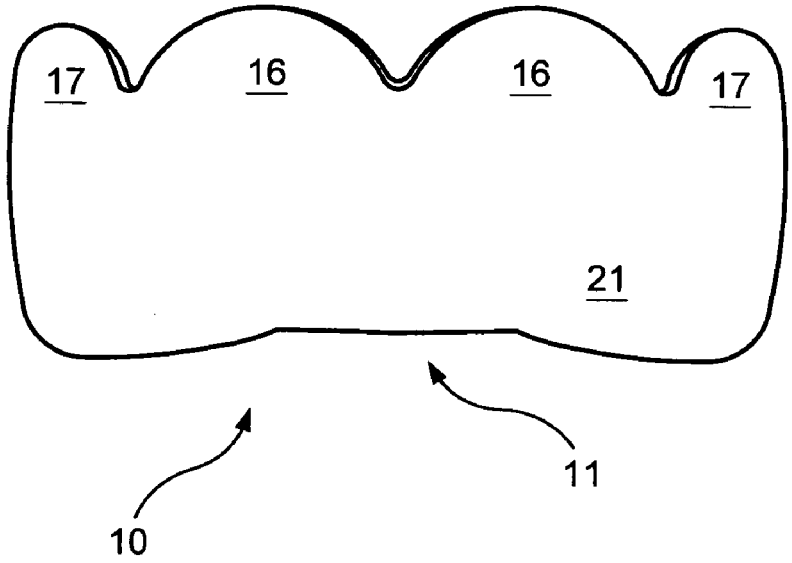
FIG. 1 is a schematic front elevation of a mouthguard to generally enclose the upper teeth of a wearer.
Figure 2:
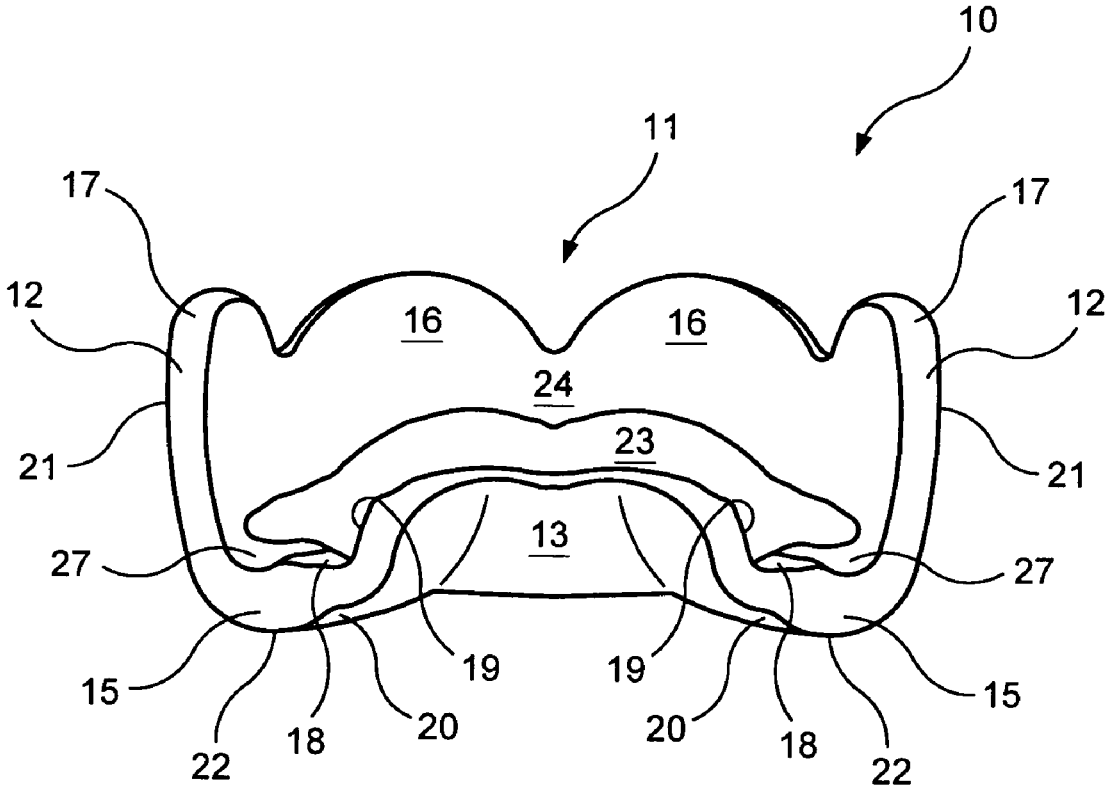
FIG. 2 is a schematic rear elevation of the mouthguard of FIG. 1.

In FIGS. 1 to 8 of the accompanying drawings, there is schematically depicted a mouthguard 10. The mouthguard 10 is of a "C-shaped" configuration so as to provide a front portion 11 from which there rearwardly diverges a pair of arms 12. The mouthguard 10 in transverse cross-section is of a "U-shaped" configuration so as to provide an inner flange 13 joined to an outer flange 14 by means of a base 15.

Figure 3:
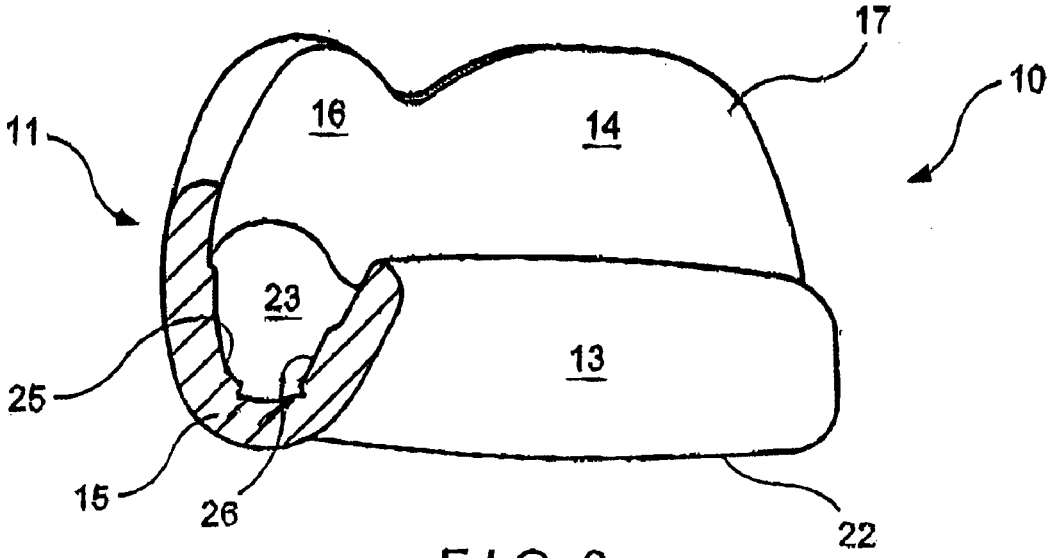
FIG. 3 is a schematic part sectioned side elevation of the mouthguard of FIG. 1.
Figure 4:
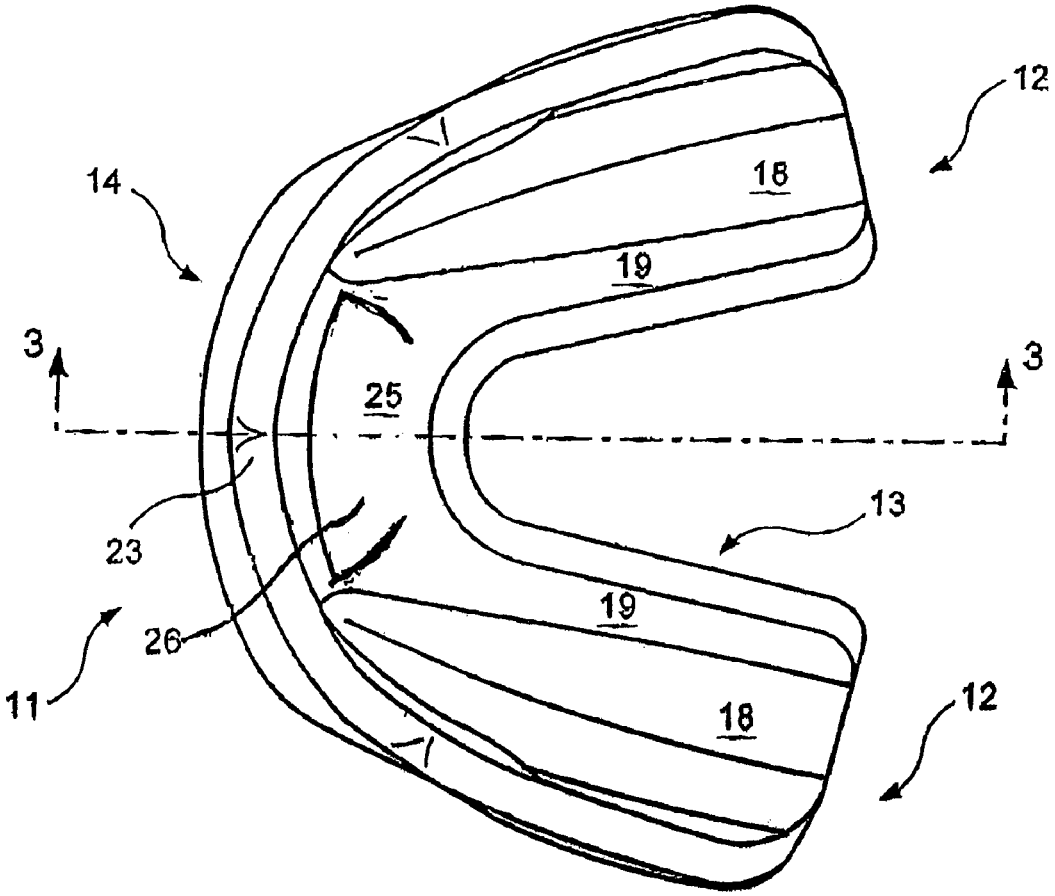
FIG. 4 is a schematic top plan view of the mouthguard of FIG. 1.
Figure 5:
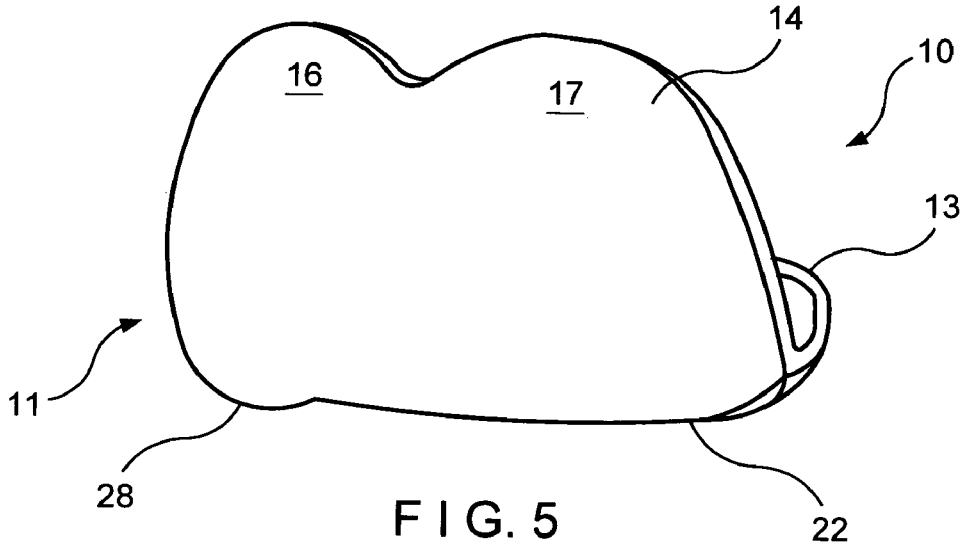
FIG. 5 is a schematic side elevation of the mouthguard of FIG. 1.
Figure 6:
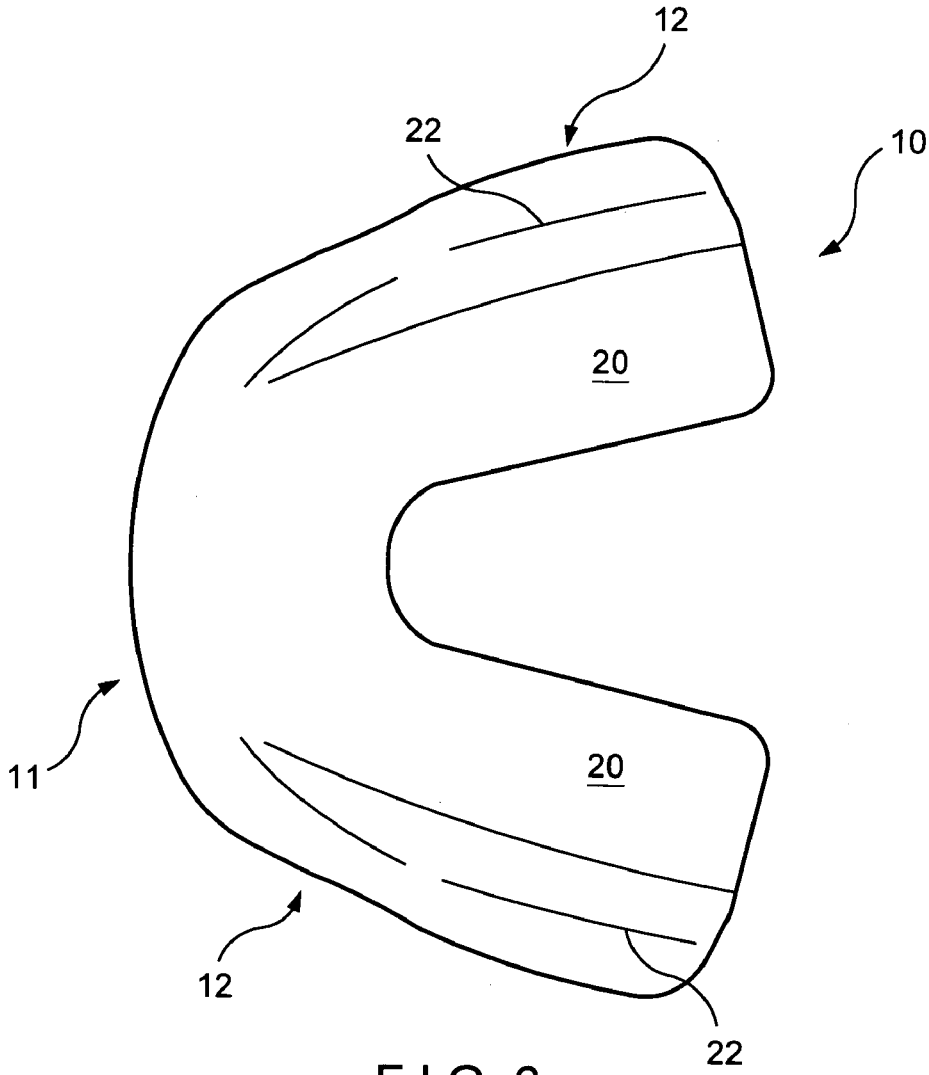
FIG. 6 is a schematic bottom plan view of the mouthguard of FIG. 1.
Figure 7:
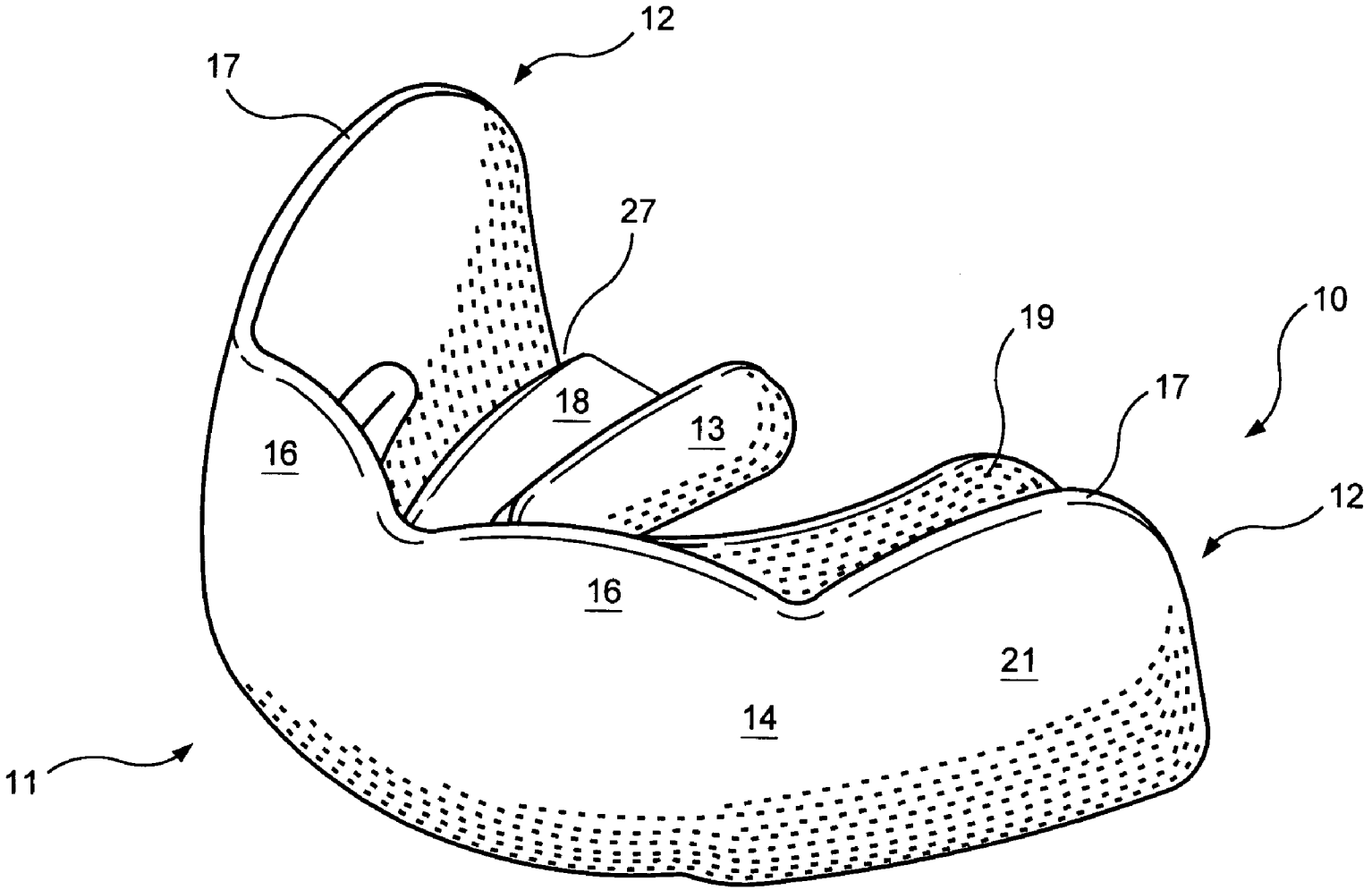
FIG. 7 is a schematic top perspective view of the mouthguard of FIG. 1.
Figure 8:
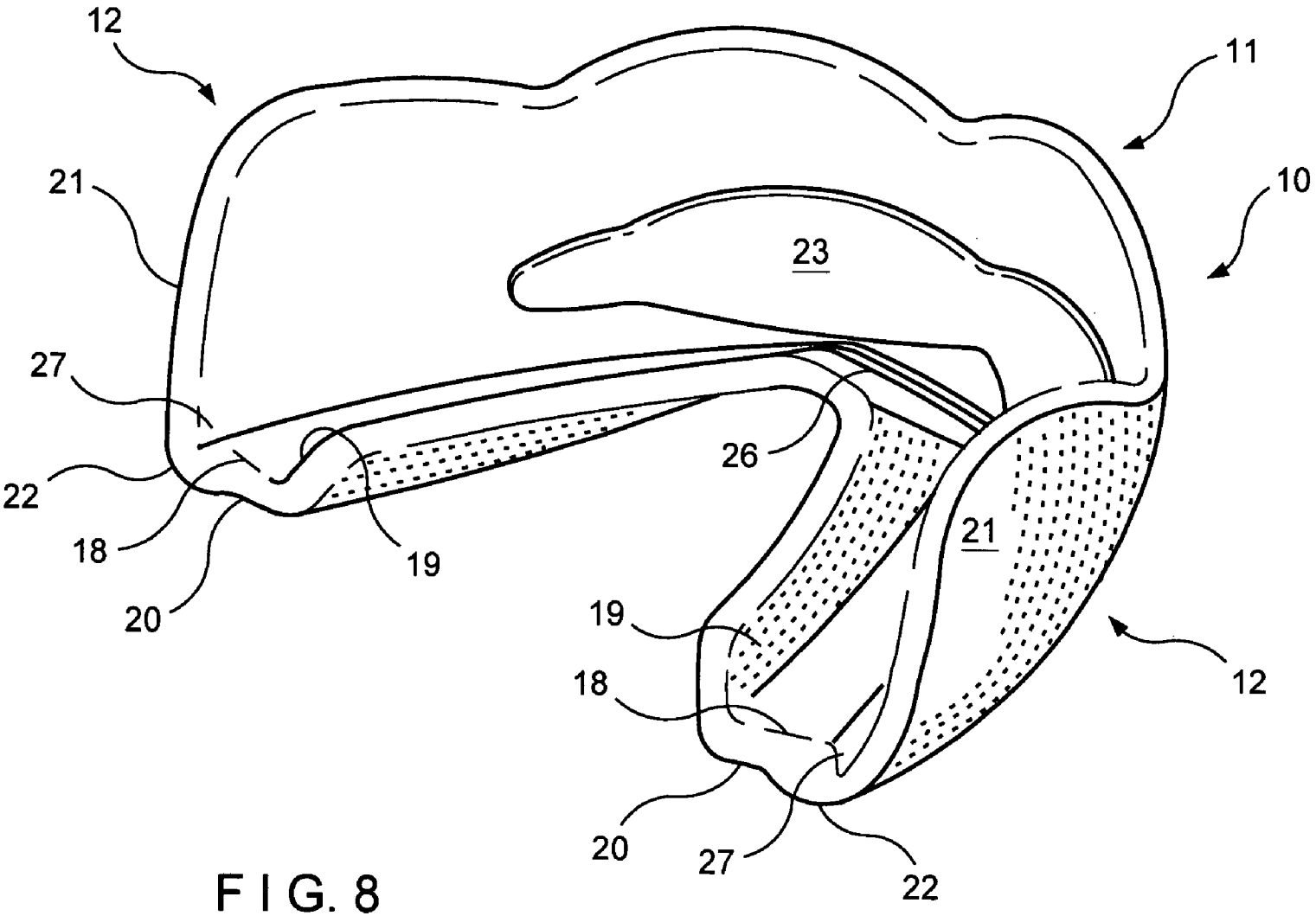
FIG. 8 is a schematic rear perspective view of the mouthguard of FIG. 1.
Figure 9:
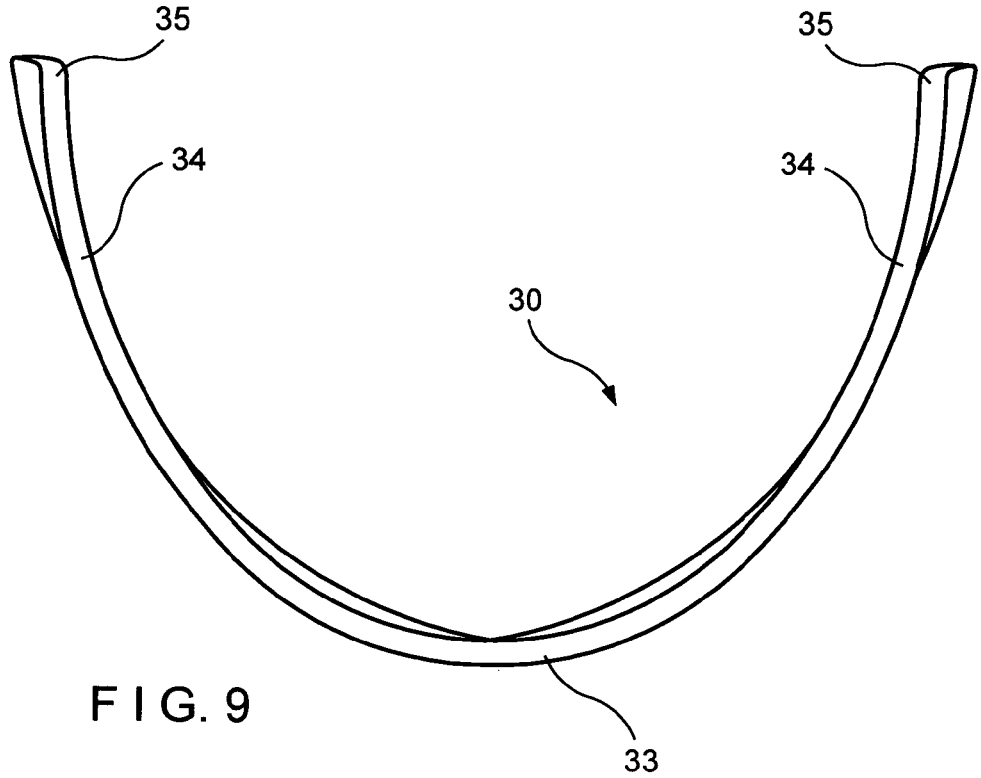
FIG. 9 is a schematic top plan view of a shield to be embedded in the body of a mouthguard.
Figure 10:
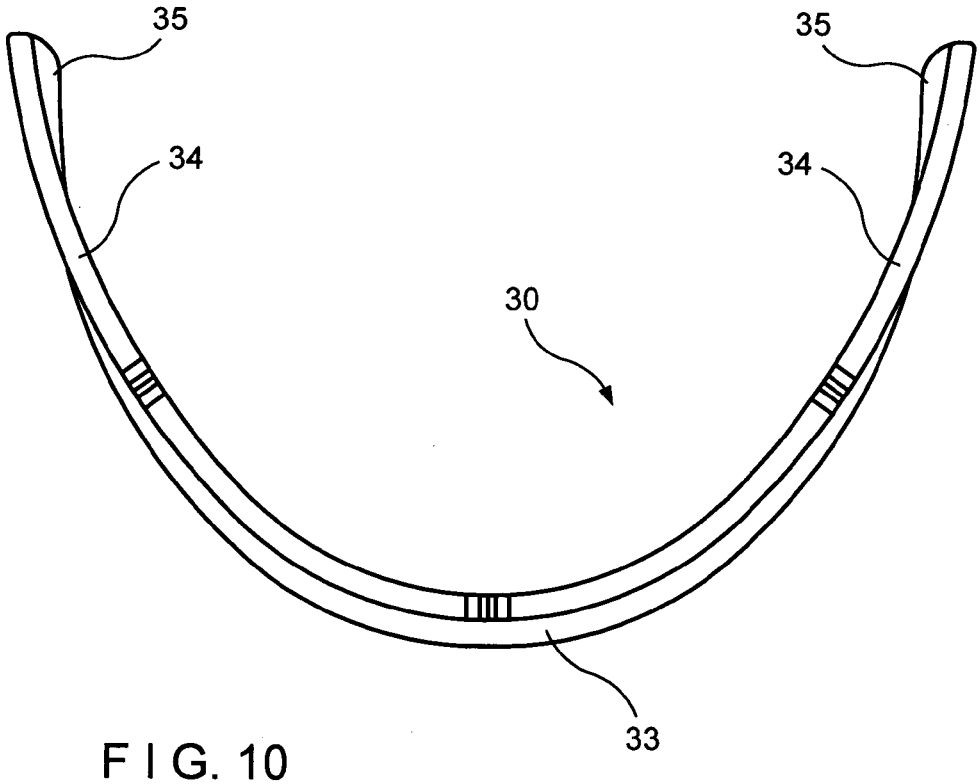
FIG. 10 is a schematic bottom plan view of the shield of FIG. 9.
Figure 11:
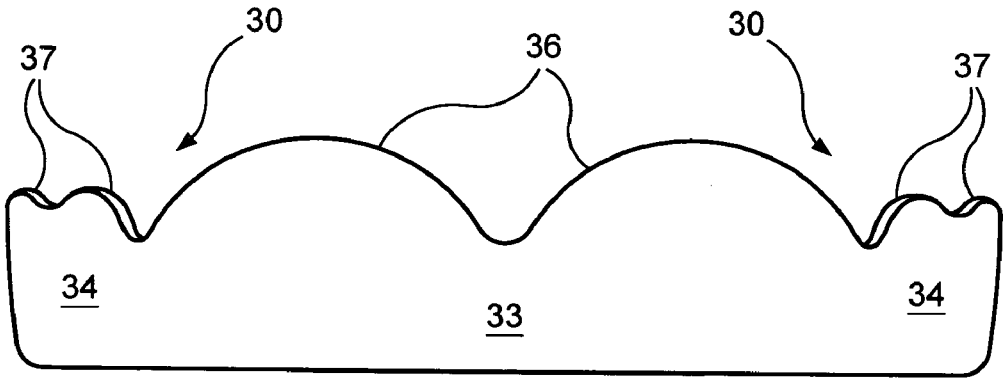
FIG. 11 is a schematic front plan view of the shield of FIG. 9.
Figure 12:
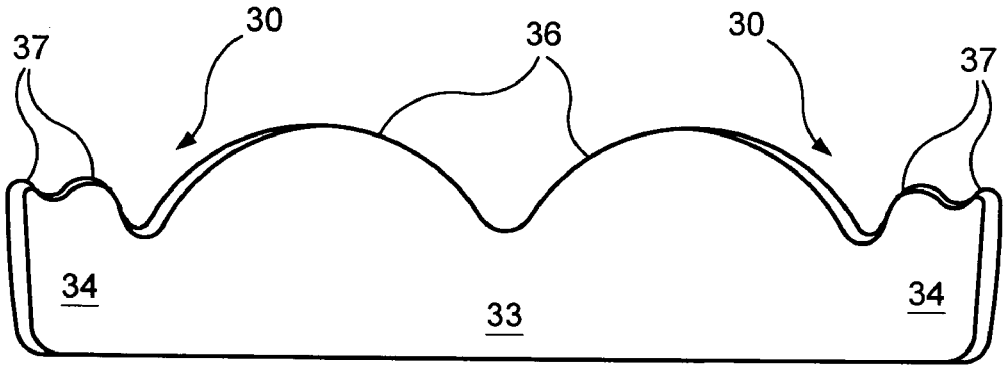
FIG. 12 is a schematic rear elevation of the shield of FIG. 9.
Figure 13:
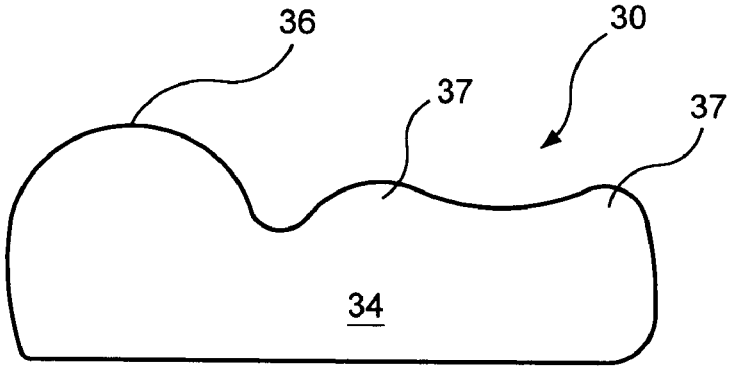
FIG. 13 is a schematic end elevation of the shield of FIG. 9.
Figure 14:
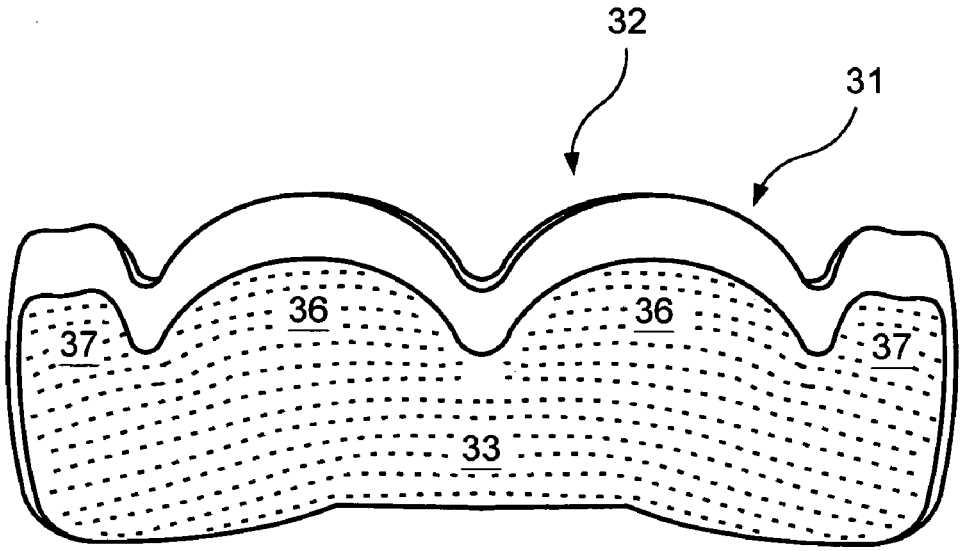
FIG. 14 is a schematic front elevation of a mouthguard having a body within which the shield of FIG. 9 is embedded.
Figure 15:
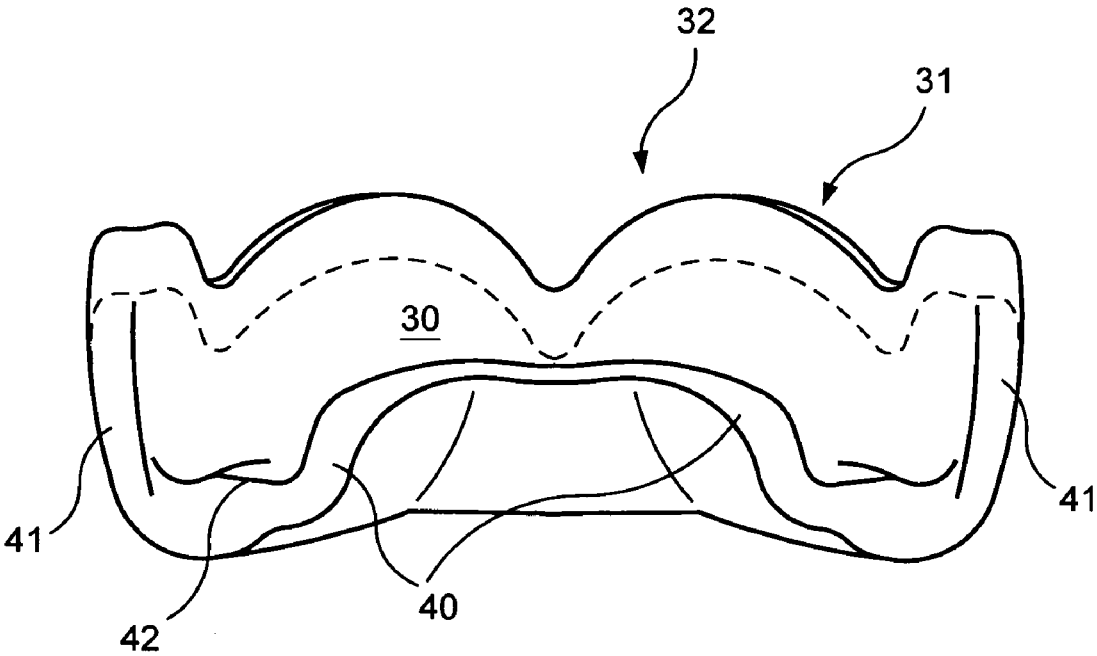
FIG. 15 is a schematic rear elevation of the mouthguard of FIG. 14.
Figure 17:
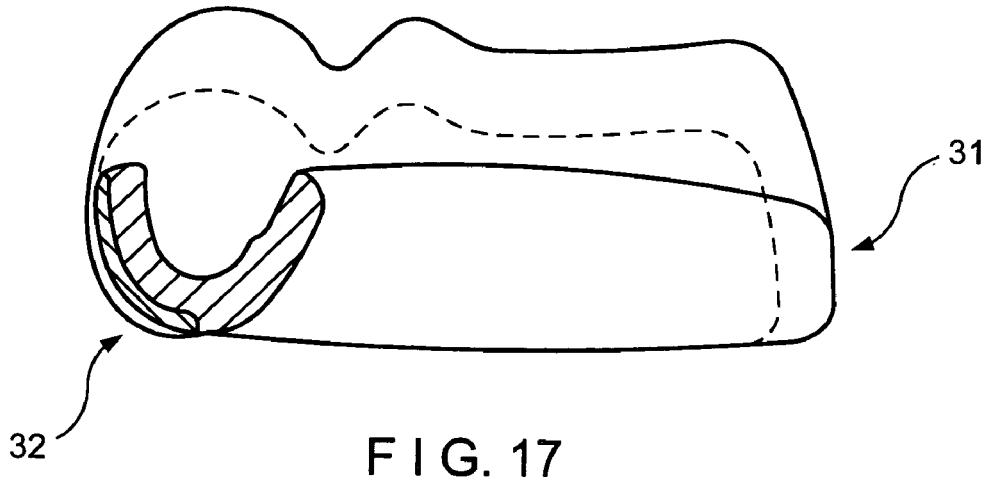
FIG. 17 is a schematic side elevation of the mouthguard as illustrated in FIG. 16, sectioned along the lines 17—17.
Figure 16:
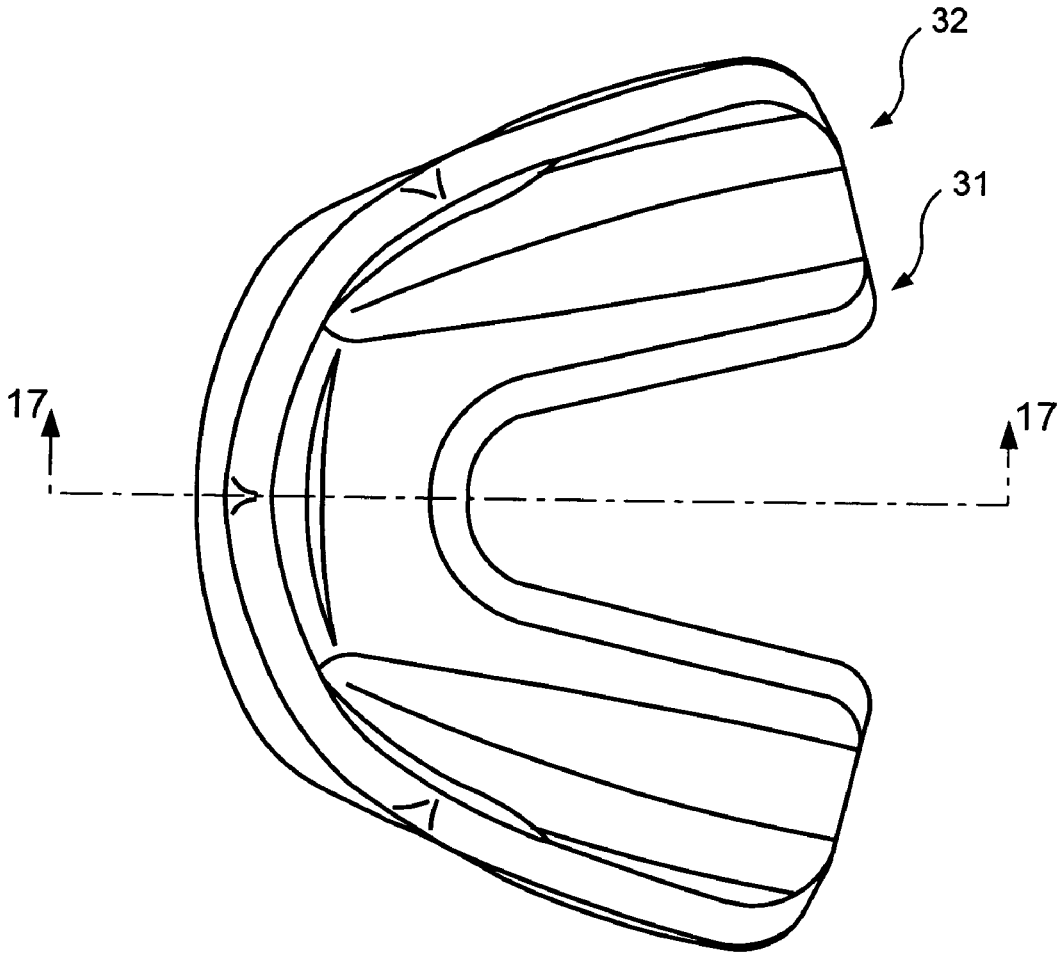
FIG. 16 is a top plan view of the mouthguard of FIG. 14.
Figure 18:
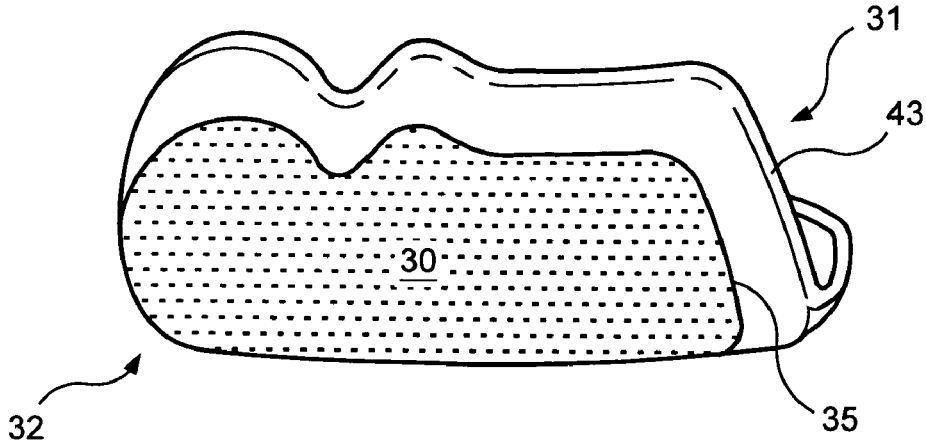
FIG. 18 is a schematic side elevation of the mouthguard of FIG. 14.
Figure 19:
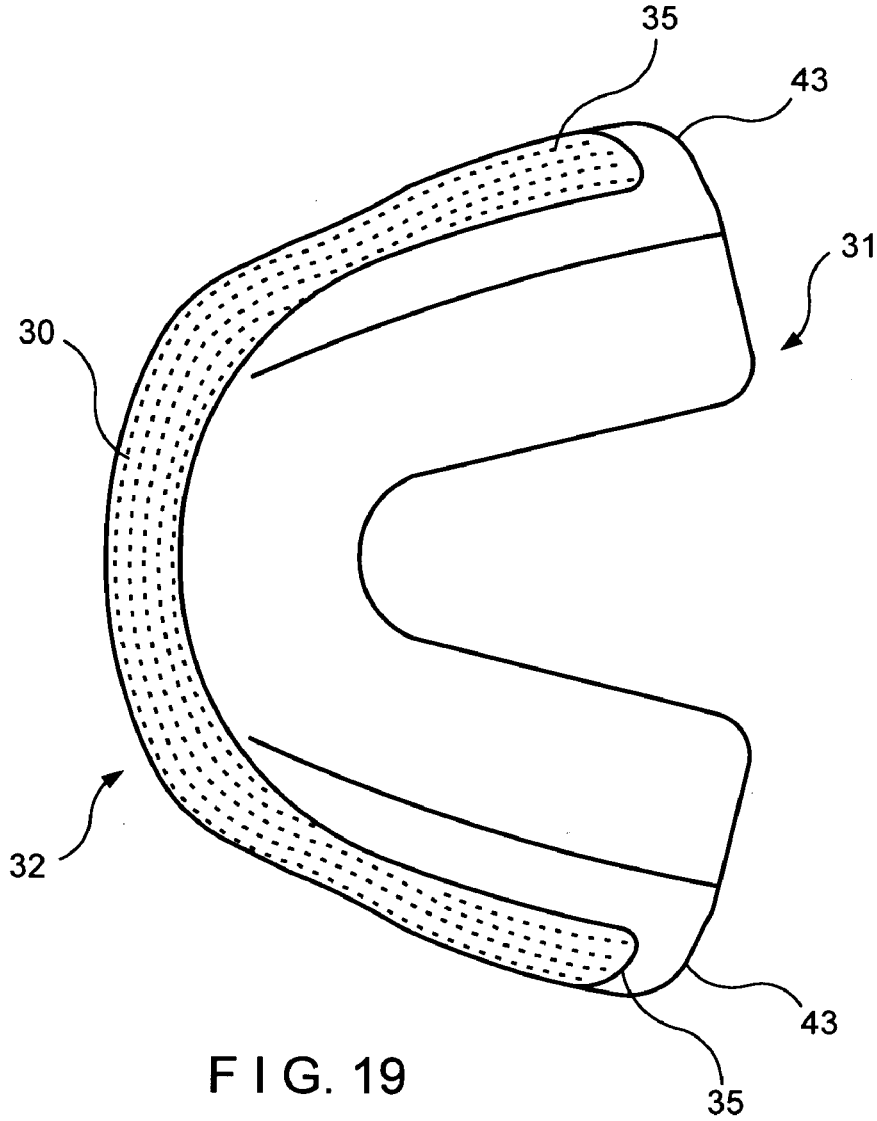
FIG. 19 is a schematic bottom plan view of the mouthguard of FIG. 14.
Figure 20:
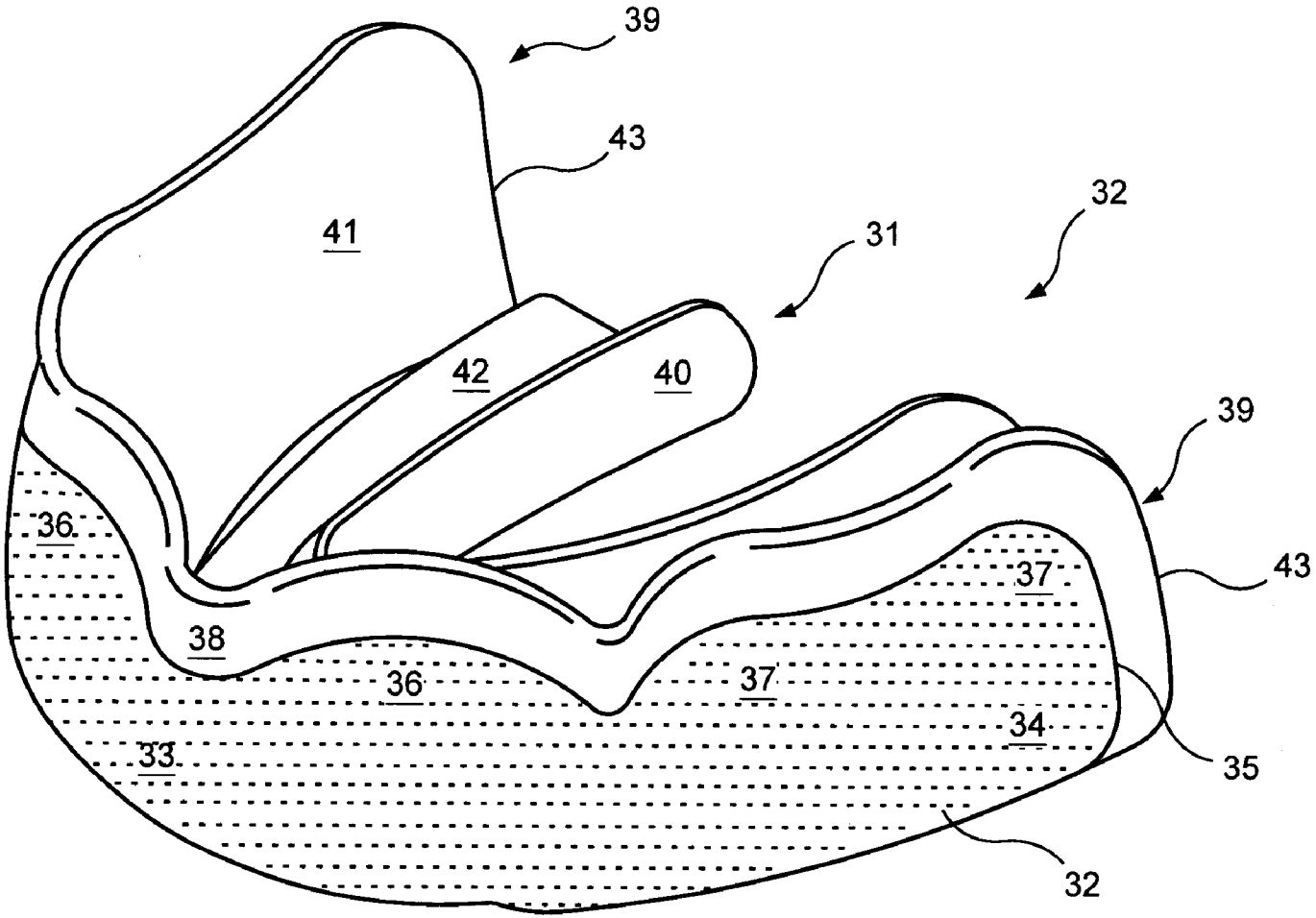
FIG. 20 is a schematic perspective view of the mouthguard of FIG. 14.

The upper edge of the flange 14 is provided with raised portions 16 and 17 arranged generally symmetrically relative to a plane passing through the line 3—3 of FIG. 4. In that regard it should be appreciated that the side elevation illustrated in FIG. 3 is the mouthguard sectioned along the line 3—3 of FIG. 4.

The base 15 of the mouthguard 10 includes upper surfaces 18 extending along each arm 12, with each surface 18 providing an occlusal table which is generally perpendicular to the flange 13. The surfaces 18 are inclined to the internal surface 19 of the inner flange 13 by an angle between 100 and 120 degrees, preferable 110 degrees.

The base 15 is also provided with a pari of lower surfaces 20, each surface 20 extending along an arm 12, with each surface 20 providing a lower occlusal table. The surface 20 are inclined to the external surface 21 of the outer flange 14 by approximately 90 degrees.

Each arm 12 is also provided with a ridge 22 which acts as a shield.

The forward portion 11 is thickened so as to provide a labial shield 23 formed on the internal surface 24 of the outer flange 14. The shield 23 extends to the trough 25 located in the forward portion 11 between the flanges 13 and 14. The forward portion 11 is also provided with a raised or thickened incisal portion 26.

Preferably, the forward portion 11 is also provided with a front shield 28 in the form of a ridge.

The mouthguard 10 is formed of thermoplastics material which when heated to approximately 40 degrees or above becomes plastically mouldable if bitten. To provide for the flow of plastics material when being formed, each of the arms 12 is provided with a trough 27 into which the plastics material can flow.

In FIGS. 9 to 13 of the accompanying drawings there is schematically depicted a labial shield 30 to be embedded in the body 31 of the mouthguard 32 (FIGS. 14 to 20).

The shield 30 is of a "C-shaped" configuration so as to forward shield portion 33 with two rearwardly extending arms 34. The arms 34 have extremities 35. The shield 30 further has a pair of front arches 36, with each arm 34 having a pair of arches 37.

The body 31 is of a "C-shaped" configuration so as to provide a front body portion 38 from which there rearwardly diverges a pair of arms 39. The body 31 is transverse cross-section is of a "U-shaped" configuration so as to provide an inner flange 40 joined to an outer flange 41 by means of a base 42. Each of the arms 39 has an extremity 43.

With the shield 30 embedded in the body 31 as illustrated in FIGS. 14–20, the shield portion 33 is embedded in the body portion 38 of the body 31. The shield arms 34 extend within the body arm 39 so that their extremities 35 terminate just short of the arm extremities 43.

Figure 21:
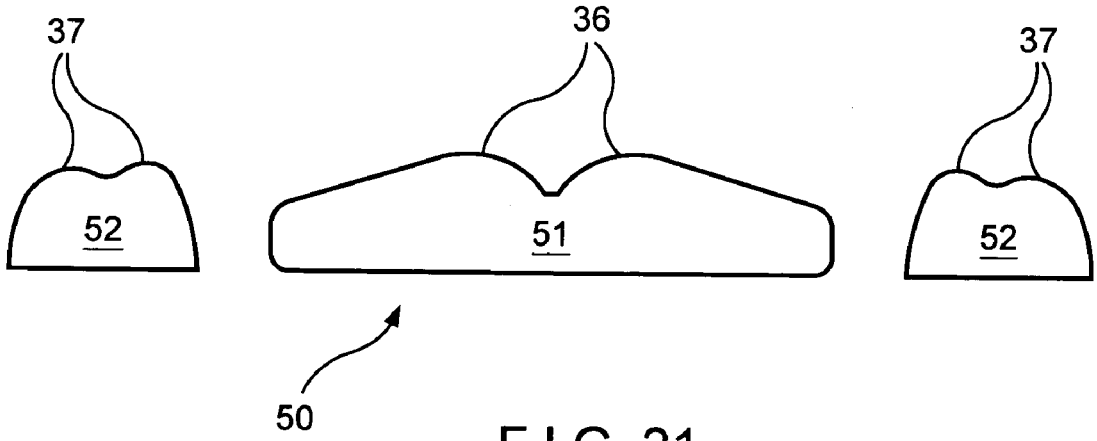
FIG. 21 is a schematic front elevation of a shield set to be embedded in a mouthguard.
Figure 22:
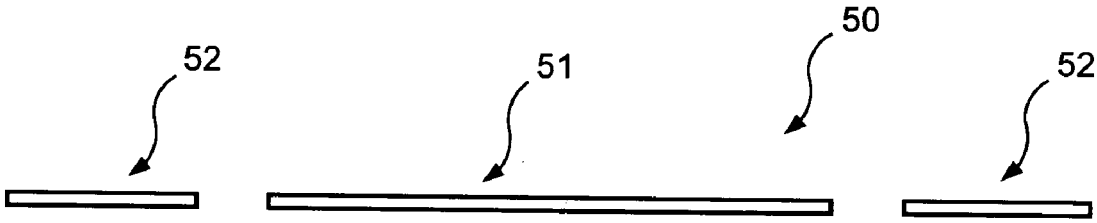
FIG. 22 is a schematic top plan view of the set of FIG. 22.
Figure 23:
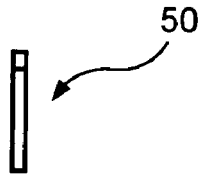
FIG. 23 is a schematic end elevation of the set of FIG. 21.
Figure 24:
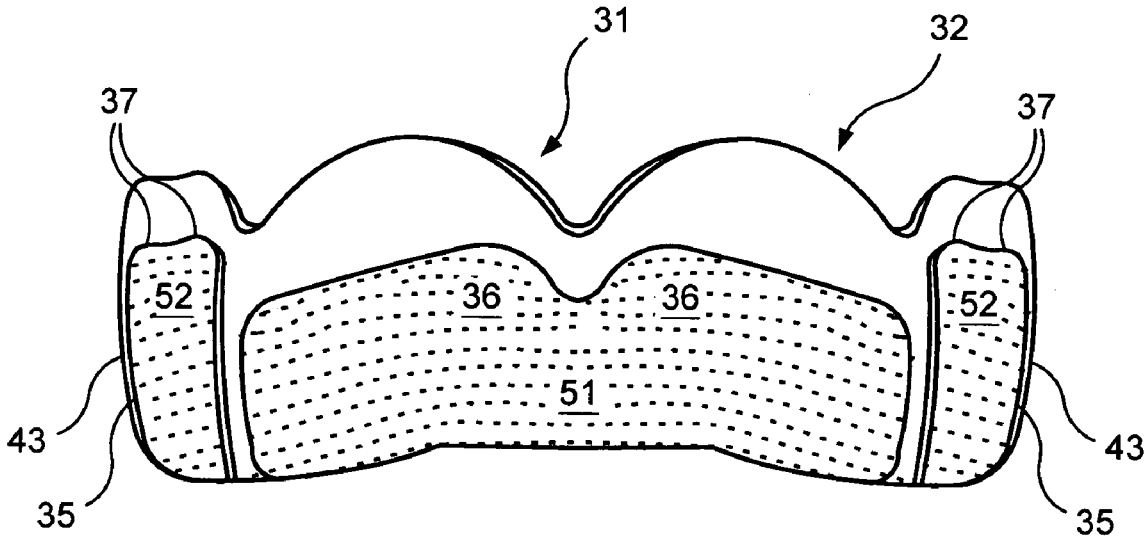
FIG. 24 is a schematic front elevation of a mouthguard with the shield set of FIG. 21 embedded therein.
Figure 25:
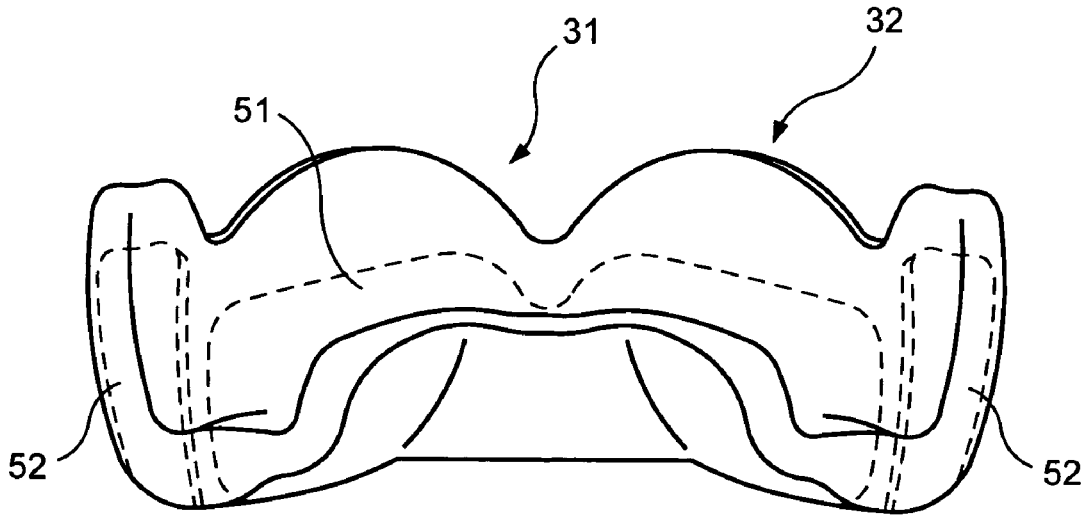
FIG. 25 is a schematic rear elevation of the mouthguard of FIG. 24.
Figure 26:
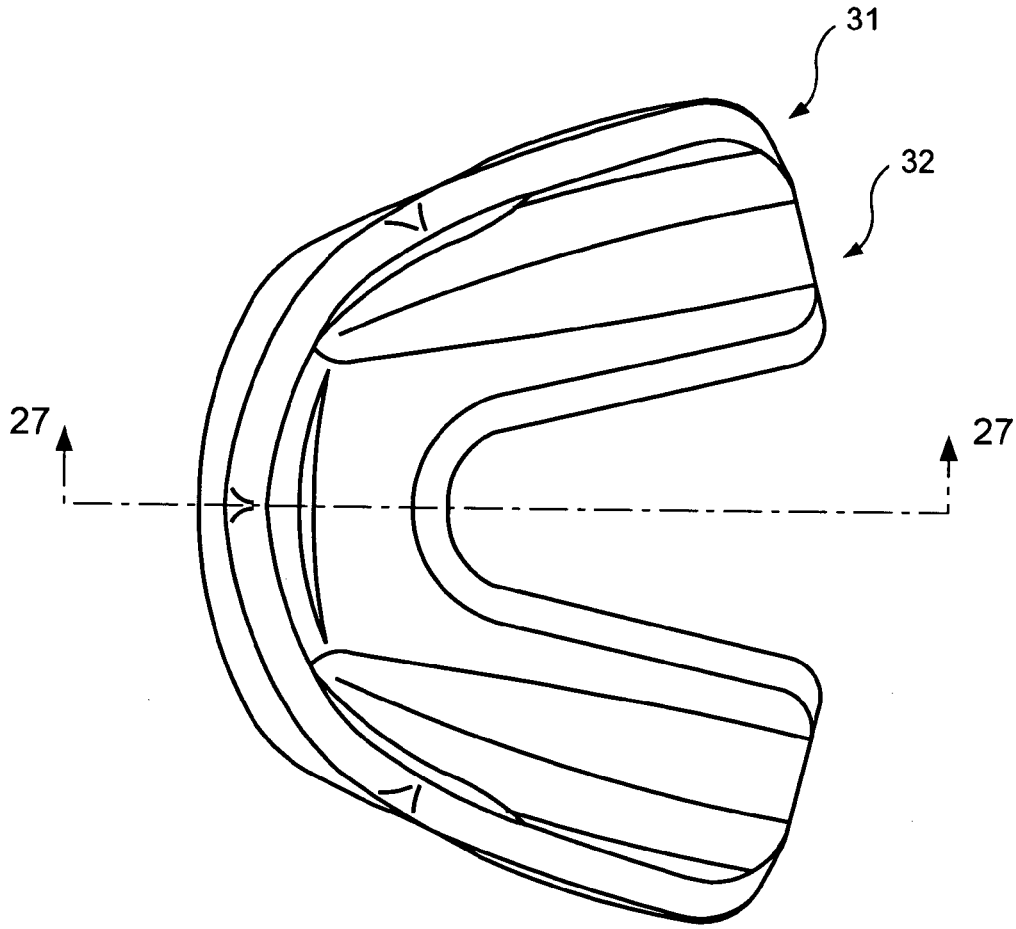
FIG. 26 is a schematic top plan view of the mouthguard of FIG. 24.
Figure 27:
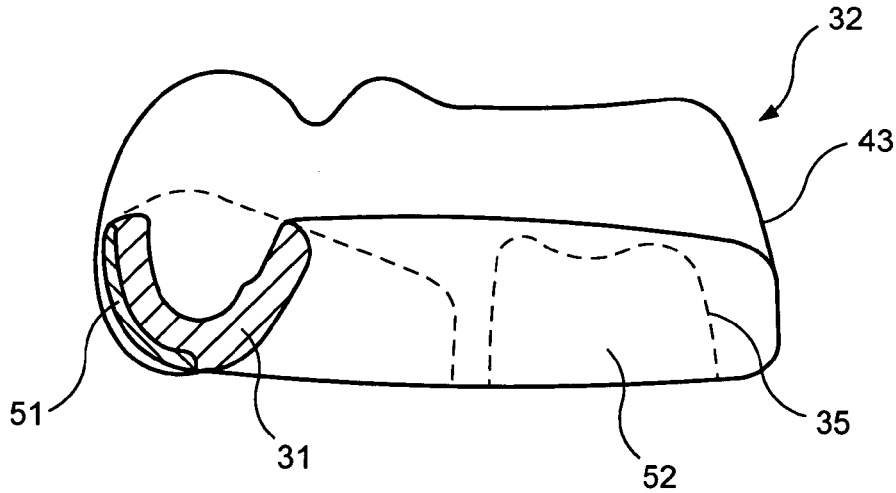
FIG. 27 is a schematic sectioned side elevation of the mouthguard as illustrated in FIG. 26, sectioned along the line 27—27.
Figure 28:
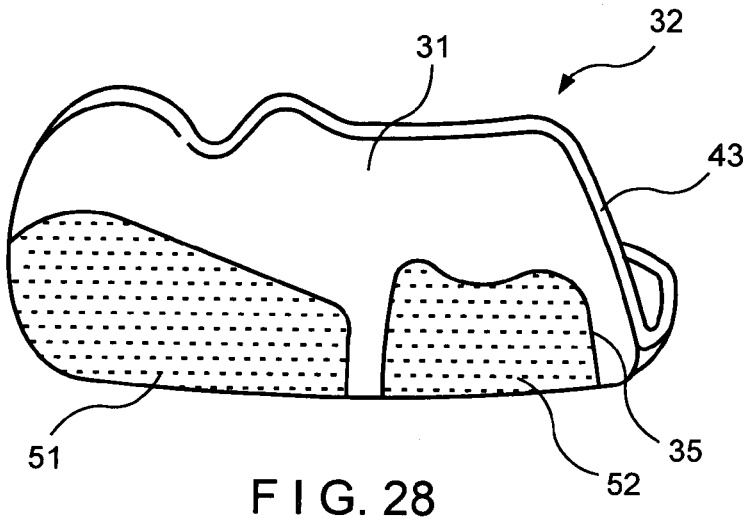
FIG. 28 is a schematic side elevation of the mouthguard of FIG. 24.
Figure 29:
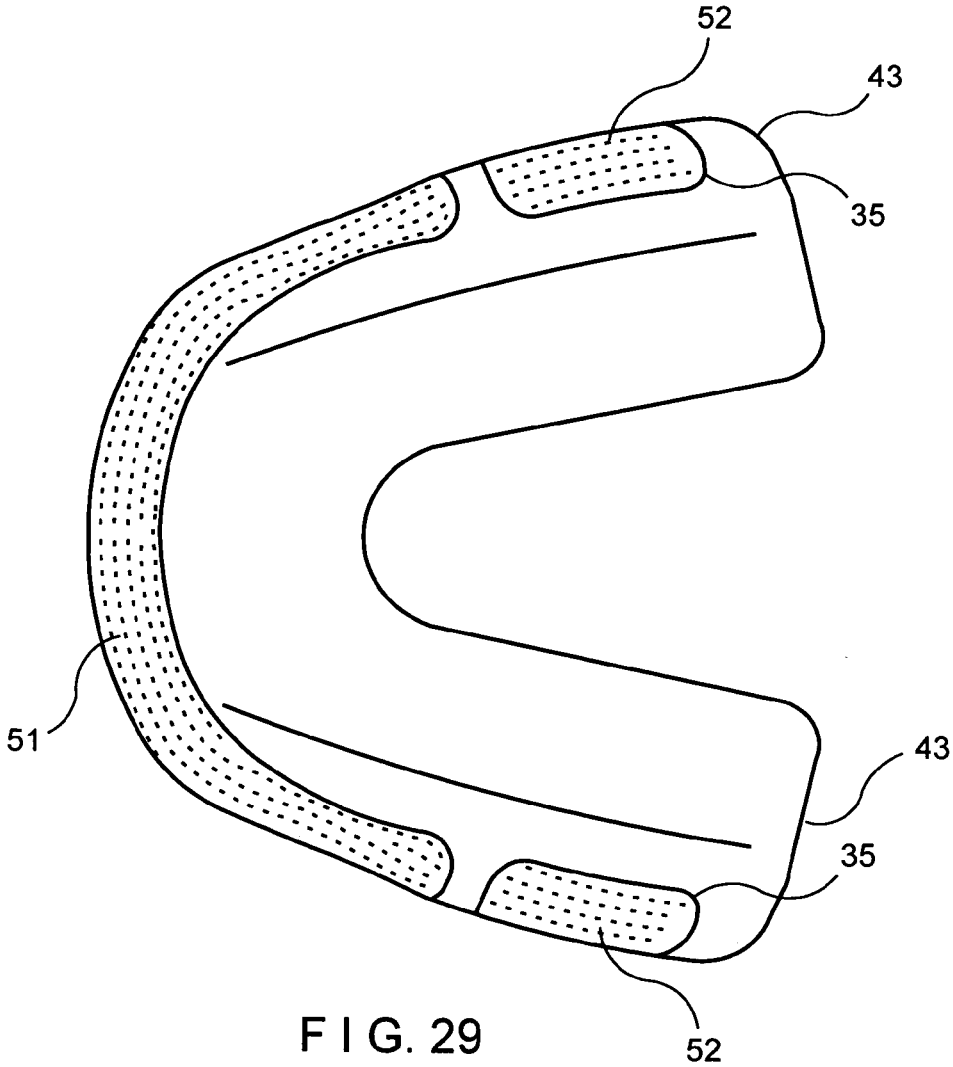
FIG. 29 is a schematic bottom plan view of the mouthguard of FIG. 24.
Figure 30:
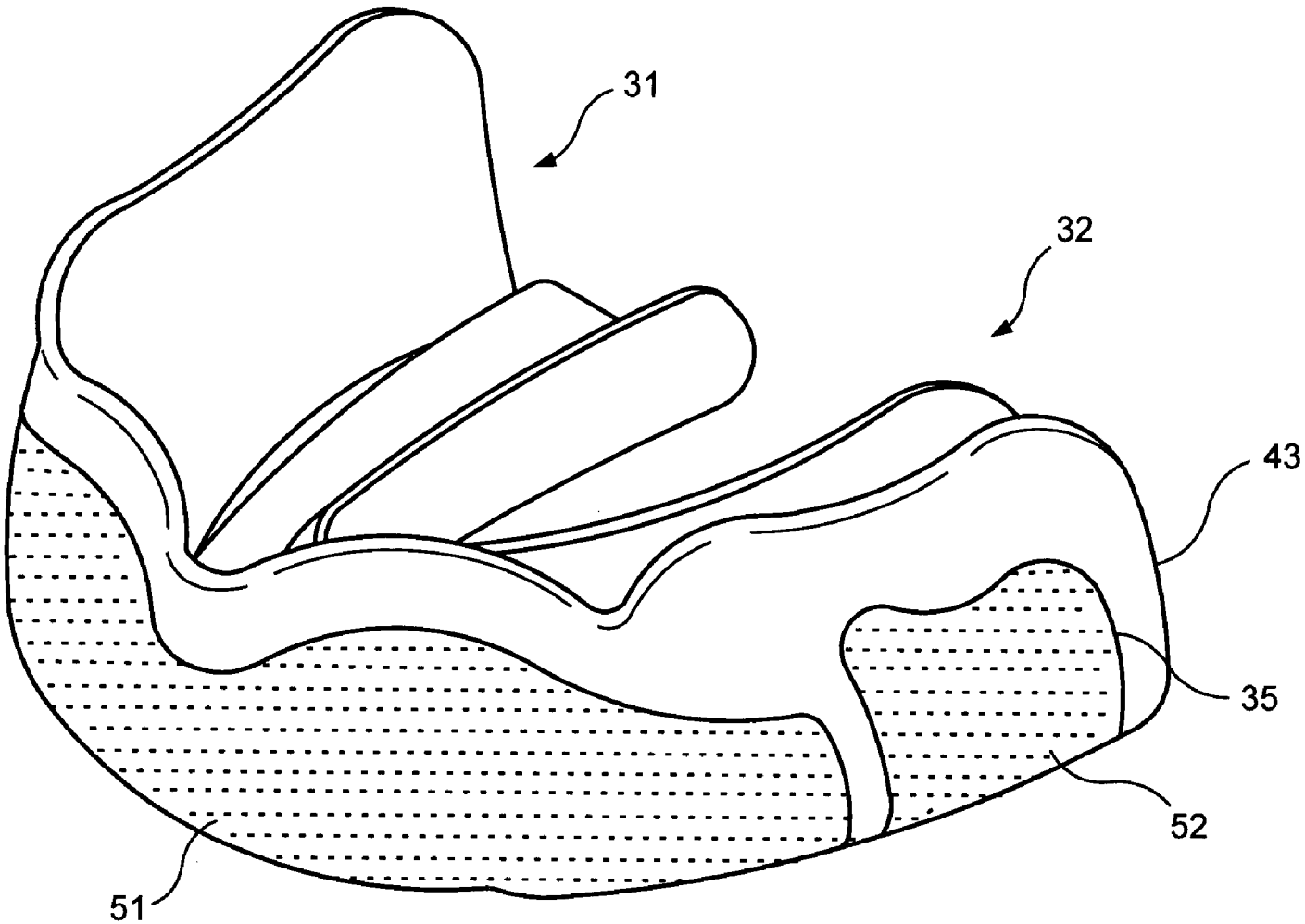
FIG. 30 is a schematic perspective view of the mouthguard of FIG. 24.

In FIGS. 21, 22 and 23 there is schematically depicted a labial shield 50 which comprises a set of shield members 51 and 52. The shield 50 is embedded (as seen in FIGS. 24 to 30) in a mouthguard body, such as the body 31 of the previous embodiment, with the shield 50 being an alternative to the shield 30. The same reference numerals have been employed in FIGS. 24 to 30, as FIGS. 14 to 20.

Figure 31:
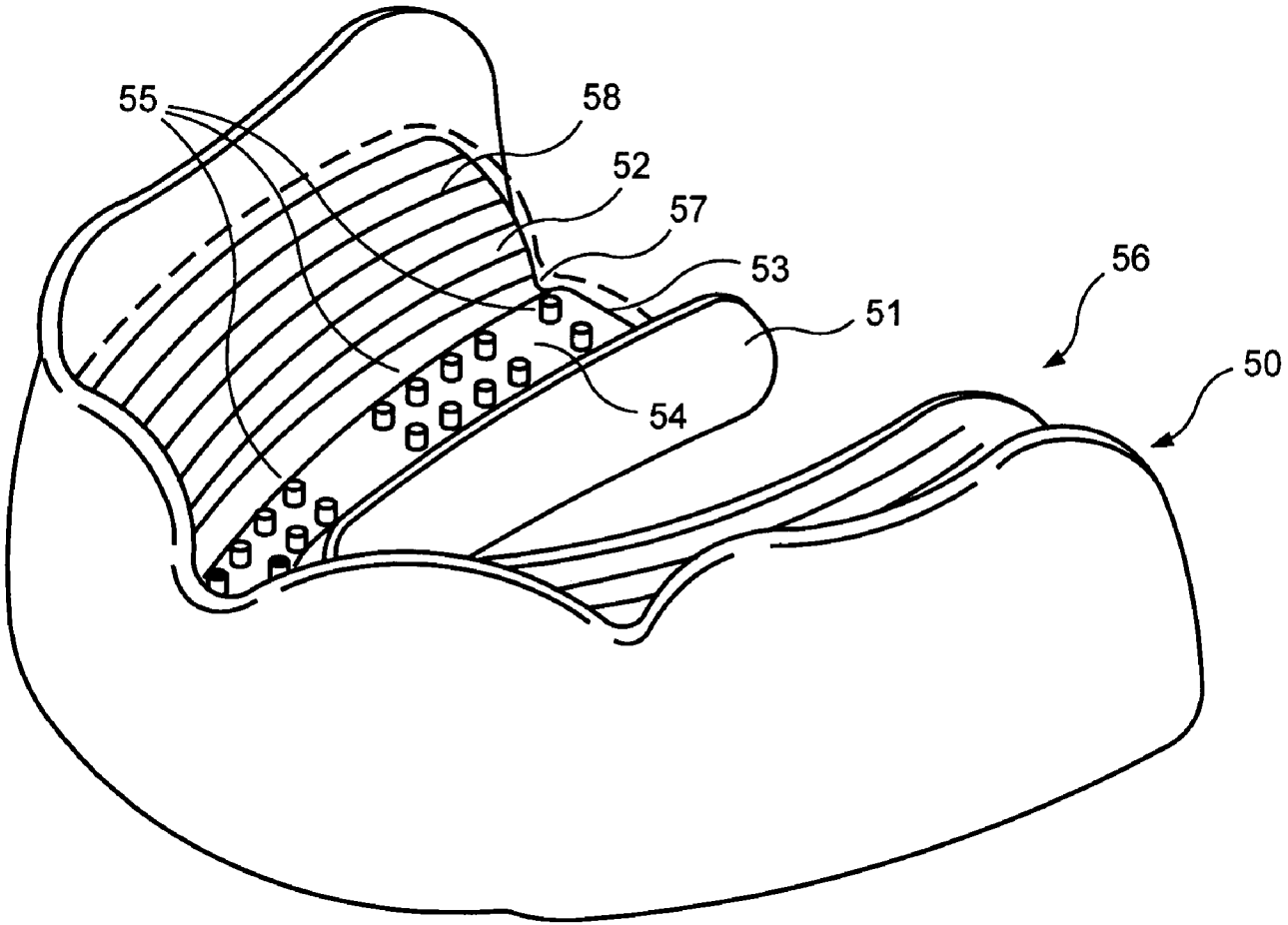
FIG. 31 is a schematic perspective view of a still further mouthguard.

In FIG. 31 there is schematically depicted a mouthguard 56 including a mouthguard body 50. The mouthguard body 50 is of a similar configuration to the previously described mouthguards. More particularly, the mouthguard body 50 has an inner flange 51 joined to an outer flange 52 by means of a base 53. The base 53 includes a layer 54 of material that is plastically deformable. More particularly, the layer 54 has a plurality of projections 55 which are plastically deformable to conform to the configuration of the user's teeth. In this embodiment the projections 55 are hollow and cylindrical inform. Received between the flanges 51 and 52 and covering the base 53 is a mouldable layer 57 constructed as follows. Firstly, the interior of the body 50 has applied to it an EVA copolymer coating. To this there is applied a thicker layer of vinyl containing polydimethylsiloxane. When the person to wear the mouthguard bites on the vinyl material, a dental impression results. However, the projections 55 also deform to provide a physical "key" to bind the vinyl layer to the body 50. In addition to, or as an alternative, the inner and outer flanges 52 and 52 may be provided with ridges 58 to again retain the vinyl layer in position. In this respect it should be appreciated that the vinyl layer may still be "peeled" from within the body 50 should the need arise. For example, when mouthguards are not professionally fitted there is a danger that the mouthguard will be applied to a person having a dental appliance. If the vinyl layer is not removable with respect to the body, considerable difficulty would be encountered in removing the mouthguard.

As an alternative or in addition to the various keying means such as the projections 50 and ridges 58, the vinyl layer may be secured to the body 50 by means of an adhesive. The adhesive may be in liquid or tape form.

In manufacturing the mouthguard body 50, internal surfaces of the mould may be acid etched in order to produce roughened surfaces (for example on the internal surfaces of the flanges 51 and 52) to aid in engaging and retaining the vinyl layer within the body 50.

The invention claimed is:

1. A mouthguard of generally "C-shaped" configuration so as to provide a front portion and two arms diverging rearwardly from the front portion, the mouthguard being of a "U-shaped" transverse cross-section so as to provide an inner and an outer flange joined by a base, wherein said base has a lower surface providing a lower occlusal table which is generally perpendicular to the inner flange with the base also having an upper occlusal table which is inclined with respect to the inner flange by an angle of between 100 and 120°.

2. The mouthguard of claim 1 including a body with said "C-shaped configuration, wherein internal surfaces of the body are provided with deformable key means to engage a mouldable material to be received within the body, said key means being pastically deformed to retain the mouldable material in the body.

3. The mouthguard of claim 2, wherein said deformable projections are located on said base.

4. The mouthguard according to claim 3 including said mouldable material within the mouthguard body.

5. The mouthguard of claim 4, wherein said projections are deformed to engage the mouldable material.

6. The mouthguard of claim 4, wherein said mouldable material is vinyl containing polydimenthlisioxane.

7. The mouthguard of claim 6, wherein said mouthguard body is formed of an EVA copolymer.

8. The mouthguard of claim 3, wherein said deformable key means comprises hollow projections of a generally cylindrical configuration.

9. The mouthguard of claim 1, wherein said outer flange includes a thickened portion at said front portion.

10. The mouthguard of claim 9, wherein the base has a lower surface provided with a shield adjacent to the outer flange, said shield extending substantially along each said arm.

11. The mouthguard of claim 1, wherein said base has an upper surface with a forward portion raised relative to arm portions thereof.

12. The mouthguard of claim 1, including a body of said "C-shaped" configuration, said arms having end extremities, said mouthguard further including a labial shield embedded in said front portion and extending therefrom along the arms to the extremities, said body and shield being formed of plastic material, with said shield being more rigid than said body.

13. The mouthguard of claim 12, wherein the shield is a single piece.

14. The mouthguard of claim 12, wherein said shield is formed of a set of shield members including a front part embedded in said front portion, and two rear parts separate from the front part, each rear part being located in a respective one of the arms.

15. A mouthguard of generally "C-shaped" configuration so as to provide a front portion and two arms diverging rearwardly from the front portion, the mouthguard being of a "U-shaped" transverse cross-section so as to provide an inner and an outer flange joined by a base, wherein said base has an upper occlusal table which is inclined to the inner flange by an angle of between 100 and 120 degrees.

16. A mouthguard of generally "C-shaped" configuration so as to provide a front portion and two arms diverging rearwardly from the front portion which has a length extending between the two arms, the mouthguard being of a "U-shaped" transverse cross-section so as to provide an inner and an outer flange joined by a base, wherein the mouthguard includes a thickened portion of said outer flange, said thickened portion being thickened across the entire length of said front portion so as to provide a labial shield.

17. A mouthguard of generally "C-shaped" configuration so as to provide a front portion and two arms diverging rearwardly from the front portion, the mouthguard being of a "U-shaped" transverse cross-section so as to provide an inner flange and an outer flange joined by a base, wherein the base has a lower surface provided with a shield in the form of a ridge below the base and extending rearwardly from adjacent the outer flange toward the inner flange, and extending substantially along each arm.

18. A mouthguard including a body of generally "C-shaped" configuration so as to provide a front portion and two arms diverging rearwardly from the front portion, the mouthguard being of a "U-shaped" transverse cross-section so as to provide an inner and an outer flange joined by a base, with said arms having end extremities, said mouthguard further including a labial shield embedded in said front portion and extending therefrom through the arms to adjacent extremities thereof so as to provide shield portions in each arm, said body and shield being formed of plastics material, with said shield being more rigid than said body.

19. The mouthguard of claim 18, wherein the shield is a single piece.

20. The mouthguard of claim 18, wherein said shield is formed of a set of shield members including a front part embedded in said front portion, and two rear parts separate to the front part, each rear part being located in a respective one of the arms.

21. A mouthguard including a mouthguard body of generally "C-shaped" configuration so as to provide a front portion and two arms diverging rearwardly from the front portion, the mouthguard being of a "U-shaped" transverse cross-section so as to provide an inner and an outer flange joined by a base, wherein internal surfaces of the body are provided with deformable key means to engage a mouldable material to be received within the body, the key means being plastically deformable to retain the mouldable material.

22. The mouthguard of claim 21, wherein means comprises deformable projections.

23. The mouthguard of claim 22, wherein the deformable projections are located on said based.

24. A mouthguard having a mouthguard body according to of claim 21, and moudlable material contained within the mouthguard body.

25. The mouthguard of claim 24, wherein the keying means are deformable projections and projections are deformed to engage the mouldable material.

26. The mouthguard of claim 24, wherein the mouldable material is vinyl containing polydimethylsiloxane.

27. The mouthguard of claim 26, wherein the mouthguard body is formed of an EVA copolymer.

* * * * *